US006028391A

United States Patent [19]

Makishima

[11] Patent Number: 6,028,391

[45] Date of Patent: Feb. 22, 2000

[54] FIELD EMISSION DEVICE HAVING SPHERICALLY CURVED ELECTRON EMISSION LAYER AND SPHERICALLY RECESSED SUBSTRATE

[75] Inventor: Hideo Makishima, Tokyo, Japan

[73] Assignee: NEC Corporation, Tokyo, Japan

[21] Appl. No.: 08/953,407

[22] Filed: Oct. 17, 1997

[30] Foreign Application Priority Data

Oct. 18, 1996 [JP] Japan ..... 8-276113

[51] Int. Cl.[7] ..... H01J 1/02

[52] U.S. Cl. ..... 313/310; 313/309; 313/336; 313/351; 313/495

[58] Field of Search ..... 313/309, 310, 313/336, 351, 495

[56] References Cited

FOREIGN PATENT DOCUMENTS

| | | |
|---|---|---|
| 4-206123 | 7/1992 | Japan . |
| 6-36680 | 2/1994 | Japan . |
| 6-208835 | 7/1994 | Japan . |
| 7-272618 | 10/1995 | Japan . |
| 8-77917 | 3/1996 | Japan . |
| 8-77918 | 3/1996 | Japan . |
| 8-115654 | 5/1996 | Japan . |
| 8-505259 | 6/1996 | Japan . |
| 8-255558 | 10/1996 | Japan . |

OTHER PUBLICATIONS

C.A. Spindt, "A Thin–Film Field–Emission Cathode", *J. Applied Physics*, vol. 39, No. 7, Jun. 1968, pp. 3504–3505.

R. Meyer, "Recent Development on "Microtips" Display at LETI", *Technical Digest IVMC 91*, Nagahama 1991, pp. 6–9.

N. Kumar et al., "Development of Nano–Crystalline Diamond–Based Field–Emission Displays", *SID 94 Digest*, pp. 43–46.

*Primary Examiner*—Vip Patel

*Attorney, Agent, or Firm*—Sughrue, Mion, Zinn, Macpeak & Seas, PLLC

[57] ABSTRACT

There is provided a field emission thin film cold cathode including a substrate, an electron-emission layer formed on the substrate and having a spherical surface or a curved surface approximated to a spherical surface recessed into the substrate, a first electrode disposed about the electron-emission layer and having a greater height from the substrate than the electron-emission layer, an electrically insulating layer formed on the first electrode, and a second electrode formed on the electrically insulating layer. The electron-emission layer may be made of monocrystalline diamond, polycrystalline diamond or amorphous diamond. The above-mentioned field emission thin film cold cathode provides an electron source which makes it no longer necessary to fabricate a micro-structured device, can be fabricated without a lithography apparatus having a high accuracy, and has a small current modulating voltage.

138 Claims, 9 Drawing Sheets

FIELD EMISSION DEVICE HAVING SPHERICALLY CURVED ELECTRON EMISSION LAYER AND SPHERICALLY RECESSED SUBSTRATE

BACKGROUND OF THE INVENTION

1. Field of the Invention

The invention relates to a field emission cold cathode emitting electrons from a thin electron-emission layer, and also to a display employing the field emission cold cathode to display visual information, such as a planar display device.

2. Description of the Related Art

There has been suggested field emission cold cathode array (FEA) including a plurality of micro cold cathodes arranged in an array, each micro cold cathode comprising a fine conical emitter and a gate electrode disposed in the vicinity of the emitter and having functions of generating a current through an emitter and controlling the thus generated current. For instance, such field emission cold cathode array has been suggested by C. A. Spindt et al. in "A Thin-Film Field-Emission Cathode", Journal of Applied Physics, Vol. 39, No. 7, June 1968, pp. 3504–3505, and by H. F. Gray.

The suggested FEA has advantages over a thermionic cathode that it can provide a higher current density, and that it has smaller dispersion in velocity of electrons emitted from an emitter. Furthermore, FEA makes smaller current noises than a single tip field emission cathode, and can operate even with a small voltage in the range of tens of volts to 200 volts even in an environment of relatively poor degree of vacuum.

FIG. 1 illustrates a conventional planar display apparatus suggested by R. Meyer et al. in "Recent Development on "Microtips" Display at LETI", Technical Digest IVMC 91, Nagahama 1991, pp. 6–9, where a plurality of FEAs 70 as electron sources are arranged in column and row. FEAs 70 emit electrons to a phosphor layer (not illustrated) disposed in facing relation with FEAs 70 to thereby cause the phosphor layer to emit lights. The illustrated planar display apparatus has advantages over a cathode ray tube (CRT) display apparatus that it is smaller in volume and weight, it consumes less power, and it can display images with higher accuracy. In addition, the illustrated planar display apparatus has advantages over a liquid crystal display (LCD) apparatus that it consumes less power, and it has wider field view angle because a phosphor layer in the illustrated planar display apparatus emits spontaneous lights.

There has been suggested a display device as electron sources where a diamond thin film having a small work function is employed, and it is unnecessary to fabricate a micro-structured device unlike the above-mentioned FEA. This display device is called an electron-emission electronic device. FIGS. 2A and 2B illustrate an example of electron-emission electronic device which has been suggested in Japanese Unexamined Patent Publication No. 6-36680.

FIG. 2A is a plan view and FIG. 2B is a side view of the suggested electron-emission electronic device. As illustrated, the electron-emission electronic device 100 includes a support substrate 103, a diamond electron-emitter 101 formed on the support substrate 103, and an anode 102 formed on the support substrate 103 in facing relation with the diamond electron-emitter 101. The diamond electron-emitter 101 is constituted of a thin monocrystalline diamond film or a thin polycrystalline diamond film, and is adhered onto the support substrate 103.

A diamond crystal has a work function smaller than that of metal and semiconductor such as silicon, and accordingly can emit electrons in an electric field having a quite small intensity. Specifically, metal and semiconductor have a critical electric field, at which electrons are emitted, of about $3\times10^7$ V/cm. In contrast, a diamond has a critical electric field of about $5\times10^5$ V/cm, which is two orders smaller than that of metal. Hence, the electron-emission electronic device is not required to have a quite sharpened structure for concentrating an electric field, and have a microstructure, unlike the above-mentioned FEA.

Japanese Unexamined Patent Publication No. 6-208835 has suggested a planar display apparatus employing a diamond layer as electron sources, which is illustrated in FIGS. 3A, 3B and 4. FIGS. 3A and 3B are cross-sectional views illustrating a single pixel in the planar display apparatus, and FIG. 4 is a perspective view illustrating the planar display apparatus employing the pixels illustrated in FIGS. 3A and 3B.

With reference to FIGS. 3A, 3B and 4, a plurality of stripe-shaped first conductive layers 112 are formed on a substrate 111, and the stripe-shaped first conductive layers 112 are covered with a phosphor layer or a cathode luminescence layer 113. A face plate 114 is spaced away from the substrate 111 in facing relation. A space between the substrate 111 and the face plate 114 is kept vacuous. A plurality of second conductive layers 115 extending perpendicularly to the first conductive layers 112 are formed on the face plate 114. A plurality of diamond layers 116 having the same width as that of the second conductive layer 115 are formed on the second conductive layers 115.

A section defined by intersection of the first conductive layer 112 with the second conductive layer 115 establishes a pixel. By applying a voltage across the first and second conductive layers 112 and 115, the diamond layers 116 emit electrons, which impinge on the phosphor layer 13 to thereby cause the phosphor layer 13 to emit lights.

As illustrated in FIG. 5, there has been suggested a display structure where a plurality of stripe-shaped grids 117 are supported by grid supports 118 between a cathode comprised of diamond layers 116 and a face plate 114, by N. Kumar et al. in "Development of Nano-Crystalline Diamond-Based Field-Emission Displays", SID 94 DIGEST, 1994, pp. 43–46.

Japanese Unexamined Patent Publication No. 7-272618 has suggested an electron source where an insulating film 124 and a gate electrode layer 125 are formed on a thin diamond film 123, as illustrated in FIG. 6.

Japanese Unexamined Patent Publications Nos. 8-77917 and 8-77918 have also suggested a field emission device including an electron source comprising a thin diamond film on which an insulating film and a gate electrode layer are formed.

As illustrated in FIG. 7, Japanese Unexamined Patent Publication No. 8-505259 corresponding to the international patent application PCT/US93/11791 or U.S. patent application Ser. No. 07/993,863 has suggested an electron source where thin, planar diamond films 131 are formed on bottom surfaces in cavities defined by a plurality of insulating films 124 and gate electrodes 125 formed on the insulating films 124.

As illustrated in FIG. 8, Japanese Unexamined Patent Publication No. 8-115654 has suggested an electron source a thin film 141 is formed on a bottom surface in a cavity defined by an insulating layer 142 and a gate electrode 144 formed on the insulating layer 142.

In a planar display apparatus including FEA where a plurality of fine sharpened emitters are arranged in an array, a plurality of micro-structures where a curvature radius of a tip end of emitters is equal to or smaller than 10 nm and a diameter of openings formed in a gate electrode are about 1 μm have to be formed all over a display panel. To this end, it would be necessary to use the latest lithography apparatus. In particular, it would be necessary to use an exposure apparatus having high resolution in order to expose resist to light for forming gate openings.

However, it would be impossible to widen an area for forming a pattern therein in such a high-resolution exposure apparatus. Accordingly, it would be necessary to repeatedly move the exposure apparatus to cover a wide area for accomplishing a wide area display. As a result, it would be unavoidable that a time for operating the exposure apparatus is longer and longer, and hence it would take much time to complete an exposure step. In addition, it would be quite difficult to fabricate emitters in an entire display area so that the emitters have a tip end having a uniform curvature radius and also have a uniform height in an evaporation step for forming emitters in Spindt type or in an etching step in Gray type.

Since the planar display apparatus illustrated in FIGS. 3A, 3B and 4 has an electron source comprised of the diamond layers 116 having a small work function, it is no longer necessary to fabricate a micro-structured device by photolithography, and it is also unnecessary to use a high resolution exposure apparatus, which ensures that fabrication steps are simplified, and that the planar display apparatus could have a simpler structure.

As mentioned earlier, the planar display apparatus controls electron emission by a voltage to be applied across the cathode or second conductive layer 115 and the anode or first conductive layer 112 covered with the phosphor layer 113. Since the cathode 115 is spaced away from the anode 112 by a distance in the range of about 10 μm to about 100 μm, it would be necessary to apply a voltage in the range of 300 V to 500 V across the cathode 115 and the anode 112 for establishing an electric field sufficiently intensive for electron emission. Hence, even the fact that voltage-current characteristic is non-linear is utilized, the voltage has to be in the range of +80 V to +150 V for modulating a current. In general, a planar display apparatus is required to have driving circuits by the number equal to the number of horizontal and vertical pixels. Accordingly, if a current modulating voltage were great, external driving circuits would have to receive quite large burden.

In addition, when a voltage applied across the anode and the cathode is varied, an acceleration voltage for causing electrons to impinge on the phosphor layer would vary similarly to an emission current. Thus, it would be difficult to accurately adjust primary colors balance in a color display, for instance.

In addition, since the thin diamond films 116 do not always have a uniform micro-structure, a part of the emitted electrons have a horizontal velocity ingredient, and hence are not directed perpendicularly to the face plate 114 and the substrate 111. Accordingly, electrons to be emitted to a certain pixel may reach an adjacent pixel, which is accompanied with a problem that resolution and contrast is reduced in a display panel, in particular, color purity may be deteriorated in a planar color display apparatus.

For instance, when a voltage of 200 V is applied across the anode and the gate electrode and the anode is spaced away from the gate electrode by 50 μm, an electron having been emitted by an angle of 30 degrees from a central axis would be radiated on a location remote from the central axis by about 15 μm in a screen on which the anode is formed.

In order to solve the above-mentioned problem, it would be necessary to design the phosphor layer to have a larger area relative to an area of an anode in a pixel, design a spacing between the anode and the phosphor layer to be smaller to thereby ensure that electron beams certainly impinge on the phosphor layer before the electron beams diverge, or form a barrier wall for physically banning electrons to reach an adjacent pixel. However, these solutions to the above-mentioned problem would cause another problem that the planar display apparatus would have limited definition, and/or would have a more complex structure.

The display apparatus illustrated in FIG. 5 has a problem that the display apparatus cannot avoid to have a complex structure because the grid 117 having square apertures a side of which is in the range of 1 μm to a few μm has to be supported between the face plate 114 and the electron source. In addition, it would be difficult to fabricate the grid 117 having the micro apertures as mentioned above.

In the electron source illustrated in FIG. 6, since projections and recesses at a surface of the thin diamond film 123 are not always arranged in a line, emitted electrons tend to have a large horizontal velocity ingredient. In addition, in a cavity defined by the insulating layers 124 and the gate electrode layers 125, there does not exist a focusing electric field directing towards a center of the gate opening, and hence a majority of emitted electrons impinge on the gate electrode layers 125. A few electrons can pass through the openings of the gate electrode layer 125. As a result, the gate electrode layer 125 is heated, and power consumption due to that cannot be disregarded. Furthermore, a temperature around the gate electrode layer 125 is caused to be increased, resulting in deterioration in a degree of vacuum inside the electron source.

The electron source illustrated in FIG. 7 has the same problem as that of the electron source illustrated in FIG. 6. Specifically, most electrons emitted from the thin diamond films 131 might impinge on the gate electrodes 125.

In the electron source illustrated in FIG. 8, the thin film 141 made of electron emitting material is formed in a cavity at a depth deeper than an interface between the insulating layer 142 and an anode electrode layer 143 to thereby let equipotential surfaces generated in the vicinity of the thin film 141 have a function of focusing emitted electrons.

However, since a step formed at the anode electrode layer 143 has a height small relative to a diameter of the electron emission area, the equipotential surfaces for focusing emitted electrons are bent only in the vicinity of an outer edge of the thin film 141. The equipotential surfaces like this are effective for focusing electrons emitted from an outer edge of the thin film 141, but not effective for focusing electrons emitted from portions of the thin film 141 other than the outer edge thereof. As a result, there is caused a problem that a majority of the emitted electrons impinge on the gate electrode 144, and that electrons having passed through the aperture of the gate electrode 144 are insufficiently focused.

SUMMARY OF THE INVENTION

It is an object of the present invention to provide a field emission thin film cold cathode in which emitted electrons are prevented from impinging on a gate electrode to thereby increase an electron utilization efficiency, prevent an increase in power consumption, and prevent reduction in reliability, and which can operate with a small current modulating voltage, sufficiently focus electrons, and provide a quality in displaying visual images. It is also an object of the present invention to provide a display including the above-mentioned field emission thin film cold cathode.

In one aspect, there is provided a field emission thin film cold cathode including (a) a substrate, (b) an electron-emission layer formed on the substrate and having a recessed spherical outer surface or a recessed curved outer surface approximated to a spherical surface, (c) a first electrode surrounding the electron-emission layer therewith and having a greater height than the electron-emission layer from the substrate, (d) an electrically insulating layer formed on the first electrode, and (e) a second electrode formed on the electrically insulating layer.

It is preferable that the recessed spherical outer surface or recessed curved outer surface has a center located either at almost the same height as that of the second electrode or higher than the second electrode.

The substrate may be made of an electrical conductor such as metal or semiconductor such as silicon. It is preferable that the electron-emission layer has a hexagonal transverse cross-section. It is preferable that the electron-emission layer is made of material having a small work function, such as monocrystalline diamond, polycrystalline diamond, and amorphous diamond.

It is preferable to set a distance between the electron-emission layer and the second electrode to be equal to or greater than a half of a length of an opening formed at the second electrode. The first electrode may have a height equal to or smaller than a half of a distance between the electron-emission layer and the second electrode.

The substrate may be formed to have a portion having a recessed spherical outer surface, in which case the electron-emission layer is formed on the portion of the substrate. When the electron-emission layer is designed to have the recessed curved outer surface, the recessed curved outer surface may be approximated to a spherical surface with a step or steps. When the recessed curved outer surface is approximated to a spherical surface with a step or steps, the substrate may be formed to have a portion having at least one step, in which case the recessed curved outer surface is formed on the portion of the substrate.

For instance, the step may be defined by planes formed at a surface of the substrate and located at different depths measured from a surface of the substrate. When the recessed curved outer surface is approximated to a spherical surface with two or more steps, the steps may be designed to have the same height or different heights, in which latter case, it is preferable that a step closer to a central axis of the recessed curved outer surface is designed to have a greater height than a height of a step more remote from the central axis.

The step or steps may be chamfered, in which case it is preferable that the step or steps is(are) chamfered so that the step or steps has(have) a rounded edge.

There is further provided a field emission thin film cold cathode including (a) a substrate at least a surface of which is made of electrically insulating material, (b) a third electrode formed on the substrate, (c) an electron-emission layer formed on the third electrode and having a recessed spherical outer surface or a recessed curved outer surface approximated to a spherical surface, (d) a first electrode surrounding the electron-emission layer therewith and having a greater height than the electron-emission layer from the substrate, (e) an electrically insulating layer formed on the first electrode, and (f) a second electrode formed on the electrically insulating layer.

When a field emission thin film cold cathode is designed to include the third electrode, it is preferable that different voltages are independently applied to the first and third electrodes.

In another aspect, there is provided a display including such a field emission thin film cold cathode as mentioned above. The display may include a plurality of the field emission thin film cold cathodes arranged in an array.

The above-mentioned field emission thin film cold cathode and display including the same both in accordance with the present invention provides various advantages. The above-mentioned field emission thin film cold cathode provides an electron source which makes it no longer necessary to fabricate a micro-structured device, can be fabricated without a lithography apparatus having a high accuracy, has a small current modulating voltage, and provides a quite small current to a gate electrode.

The display including the above-mentioned field emission thin film cold cathode could have a simpler structure, have a wider area, and have a small current modulating voltage. In addition, since few electrons impinge on a phosphor in an adjacent pixel, it would be possible to improve resolution, contrast and color purity.

Furthermore, since a current and an acceleration voltage can be independently determined, it would be possible to optimally adjust brightness and hue of a display panel. A cathode may be sufficiently spaced away from an anode to thereby make vacuum exhaust resistance smaller, because electron beams have small divergence, and it is no longer necessary to take a current out of a cathode by means of an electric field formed in the vicinity of the cathode by a voltage applied across an anode and a cathode. In addition, since a problem about electrical isolation between a cathode and an anode is solved to some degree, it would be possible to make an anode voltage higher, which ensures higher emission brightness and higher emission efficiency.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 1:
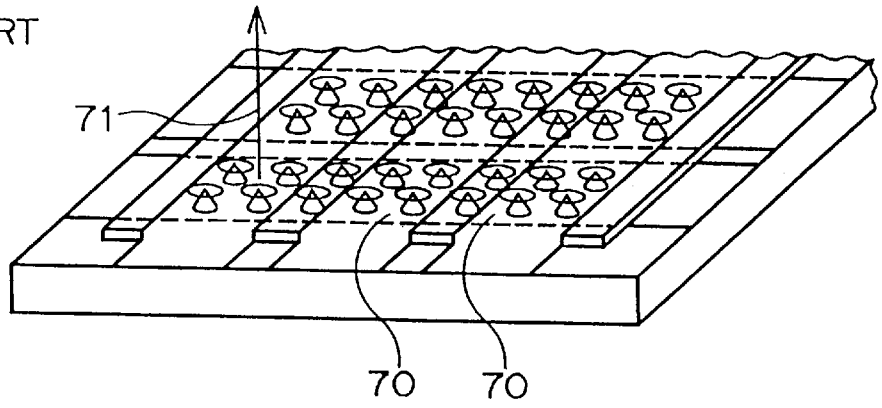
FIG. 1 PRIOR ART
FIG. 1 is a perspective view illustrating a conventional planar display apparatus.
Figure 2A:
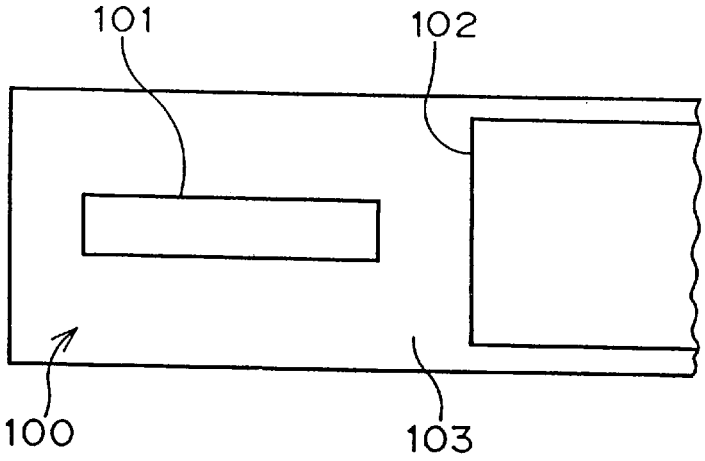
FIG. 2A PRIOR ART
FIG. 2A is a plan view of an electronic device employing a diamond film electron source.
Figure 2B:
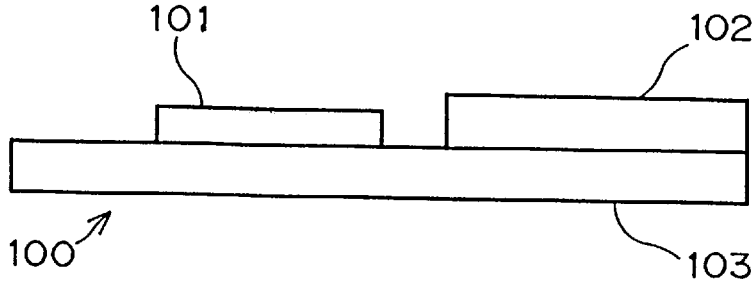
FIG. 2B PRIOR ART
FIG. 2B is a cross-sectional view of the electronic device illustrated in FIG. 2A.
Figure 3A:
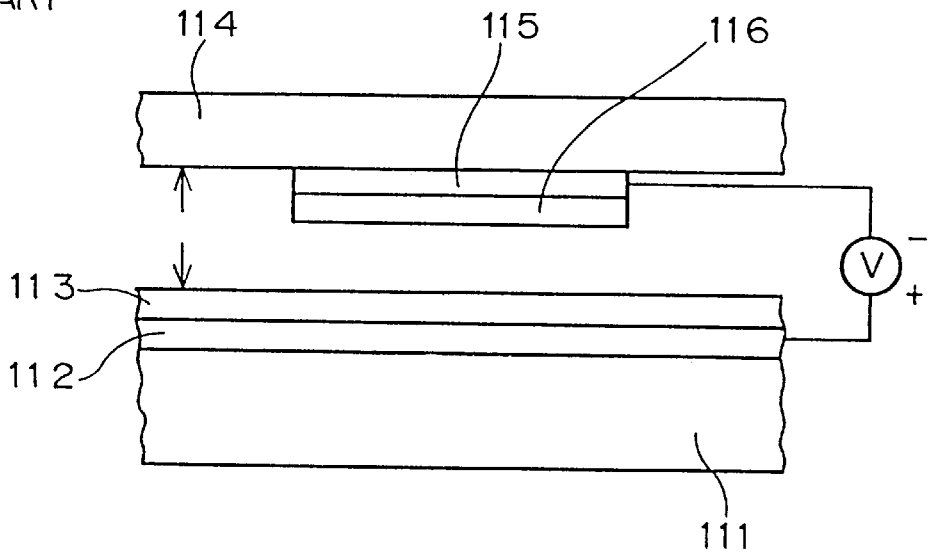
FIG. 3A PRIOR ART
FIG. 3A is a longitudinal cross-sectional view illustrating a conventional planar display apparatus employing a diamond electron source.
Figure 3B:
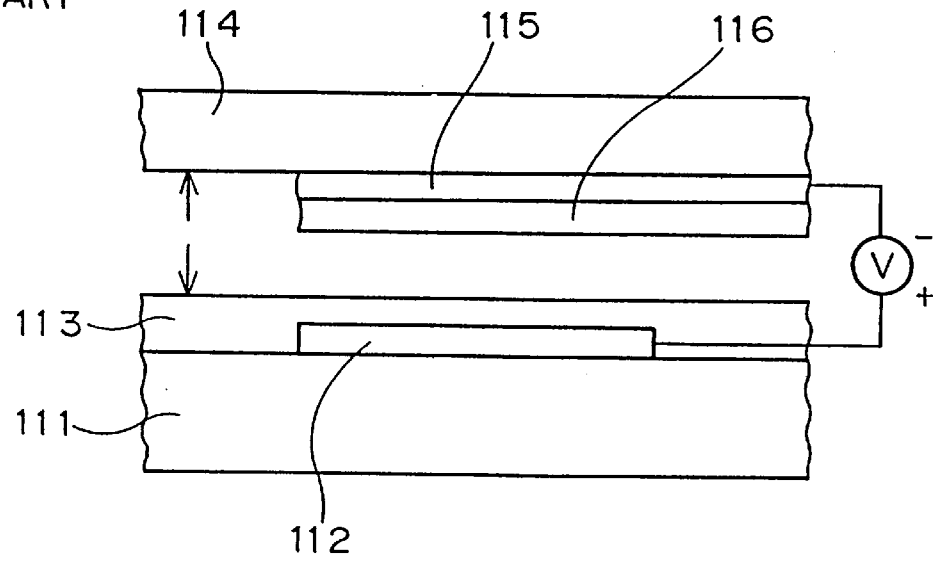
FIG. 3B PRIOR ART
FIG. 3B is a transverse cross-sectional view of the planar display apparatus illustrated in FIG. 3A.
Figure 4:
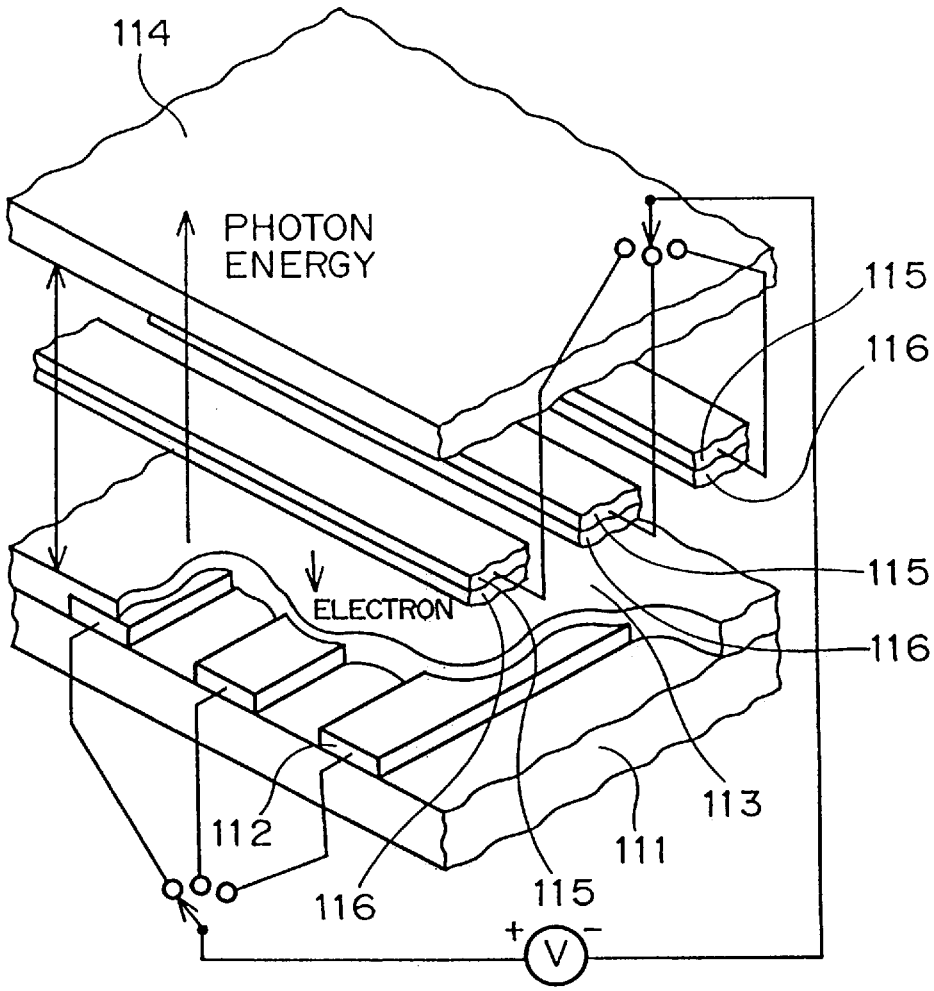
FIG. 4 PRIOR ART
FIG. 4 is a perspective view of the planar display apparatus illustrated in FIGS. 3A and 3B.
Figure 5:
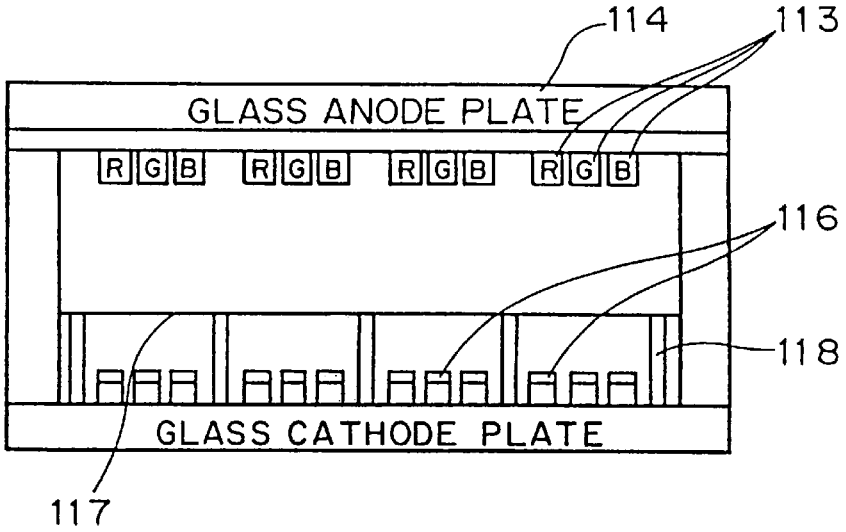
FIG. 5 PRIOR ART
FIG. 5 is a cross-sectional view illustrating another conventional planar display apparatus.
Figure 6:
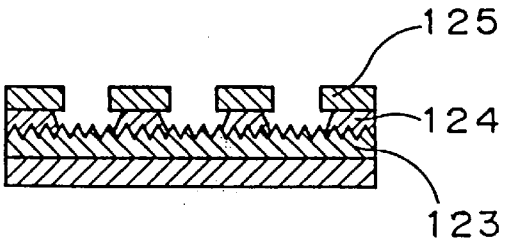
FIG. 6 PRIOR ART
FIG. 6 is a cross-sectional view illustrating a conventional planar display apparatus employing a diamond electron source.
Figure 7:
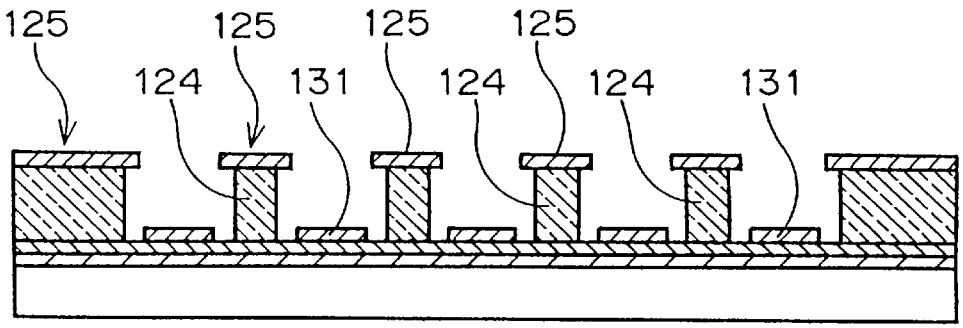
FIG. 7 PRIOR ART
FIG. 7 is a cross-sectional view illustrating another conventional planar display apparatus employing a diamond electron source.
Figure 8:
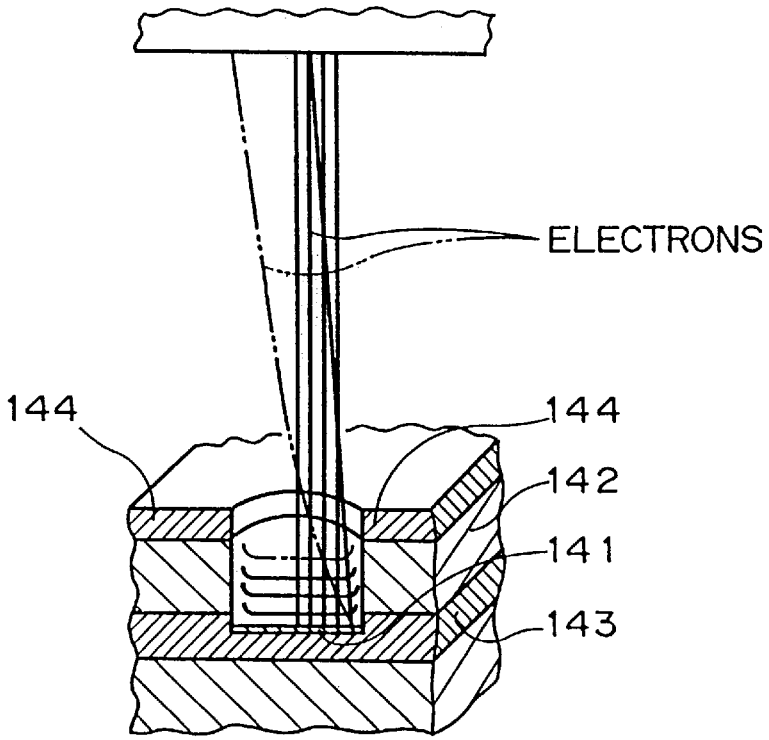
FIG. 8 PRIOR ART
FIG. 8 is a cross-sectional view illustrating still another conventional planar display apparatus employing a diamond electron source.
Figure 9:
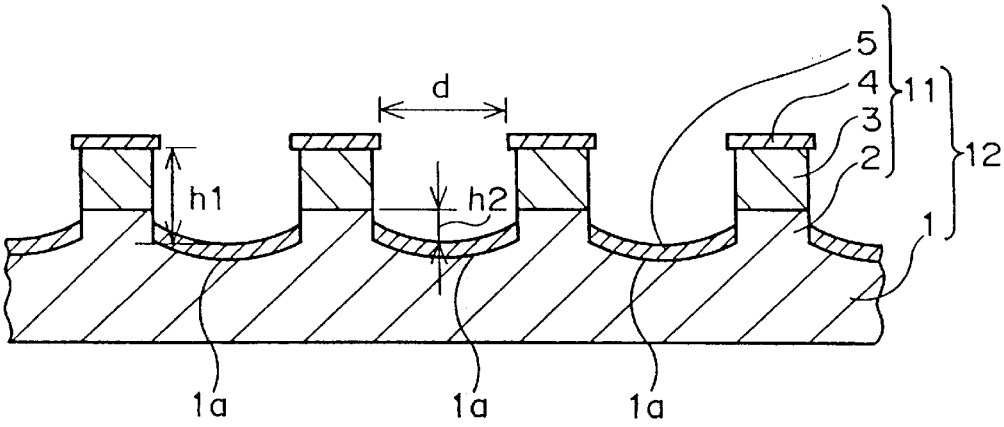
FIG. 9 is a cross-sectional view illustrating a field emission thin film cold cathode in accordance with the first embodiment of the present invention.
Figure 10:
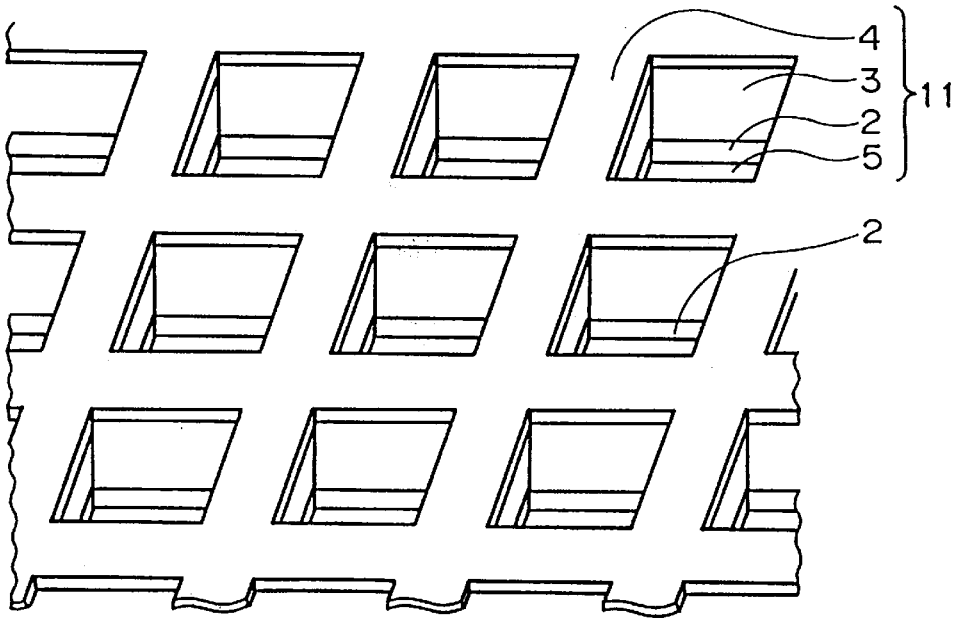
FIG. 10 is a perspective view illustrating the field emission thin film cold cathode illustrated in FIG. 9.

FIGS. 9 and 10 illustrate a field emission thin film cold cathode in accordance with the first embodiment of the present invention. A substrate 1 is formed at a surface thereof with a plurality of recesses 1*a* having a transverse rectangular cross-section. The recesses la are equally spaced away from one another. There are formed a plurality of projections 2 between the adjacent recesses 1*a*. The projections 2 act as a beam formation electrode. An insulating layer 3 is formed on the beam formation electrode 2, and a gate electrode 4 is formed on the insulating layer 3, as illustrated in FIGS. 9 and 10. The gate electrode 4 is constituted of a thin or thick metal film.

The recesses la are designed to have a spherical bottom surface, on which electron-emission layers 5 are formed. The electron-emission layers 5 are made of material having a small work function, and have a spherical outer surface dependent on the spherical bottom surface of the recesses 1*a*. As illustrated in FIG. 9, the electron-emission layers 5 are surrounded with the beam formation electrodes 2, the insulating layer 3 and the gate electrode 4. The beam formation electrodes 2 have a greater height measured from the substrate 1 than the electron-emission layers 5. As illustrated in FIG. 10, the gate electrode 4 is formed with a plurality of rectangular openings in alignment with the electron-emission layers 5, and accordingly is in the form of a mesh.

The electron-emission layer 5, the beam formation electrode 2 surrounding the electron-emission layer 5, the insulating layer 3, and the gate electrode 4 cooperate with one another to thereby form a micro cold cathode 11. A single or a plurality of micro cold cathode(s) 11 cooperate with the substrate 11 to form a cathode 12.

The insulating layer 3, the gate electrode 4 and the electron-emission layers 5 are designed to have dimensions determined in line with the use of the cathode 12. In the instant embodiment, the openings formed in the gate electrode 4 are designed to be a square a side (d) of which has a length in the range of about 5 $\mu$m to multiple tens $\mu$m.

A distance (h1) measured from a center of an outer surface of the electron-emission layer 5 to a bottom surface of the gate electrode 4 is designed to be equal to or greater than a half of the length (d) of the side of the gate electrode opening in order for a voltage applied to the gate electrode 4 to establish an electric field effective to an entire area of the electron-emission layers 5. In order to prevent excessive focusing, the beam formation electrodes 2 are designed to have a height (h2) equal to or smaller than a half of the above-mentioned distance (h1) measured from the electron-emission layer 5 to the gate electrode 4.

As mentioned earlier, the recesses 1*a* of the substrate 1 are designed to have a spherical outer surface. It should be noted that the recesses 1*a* might be designed to have a curved outer surface approximated to a spherical surface, as explained in the subsequent embodiments. The recesses 1*a* having a spherical outer surface or a curved outer surface approximated to a spherical outer surface have a curvature a center of which is located either at almost the same height as that of the gate electrode 4 or higher than the gate electrode 4.

The substrate 1 is made of electrical conductor such as metal or semiconductor such as silicon. The insulating layer 3 is made of silicon oxide or silicon nitride. The gate electrode 4 is made of material of which a wiring layer is made. However, it is preferable that the gate electrode 4 is made of refractory material such as tungsten (W), molybdenum (Mo), niobium (Nb) and compounds thereof. The electron-emission layers 5 are made of material having a small work function. It is preferable that the electron-emission layer 5 are made of at least one of monocrystalline diamond, polycrystalline diamond, and amorphous diamond. Herein, the term "amorphous diamond" means a thin film formed, for instance, by laser averation of carbon, and having amorphous condition, ultramicro diamond crystal condition, or condition of mixture thereof.

When the cathode 12 is to be operated, a voltage in the range of about 10 V to multiple tens V relative to a voltage of the substrate 1 and the electron-emission layers 5 is applied to the gate electrode 4. The thus applied voltage causes the electron-emission layers 5 to emit electrons therefrom.

Figure 11:
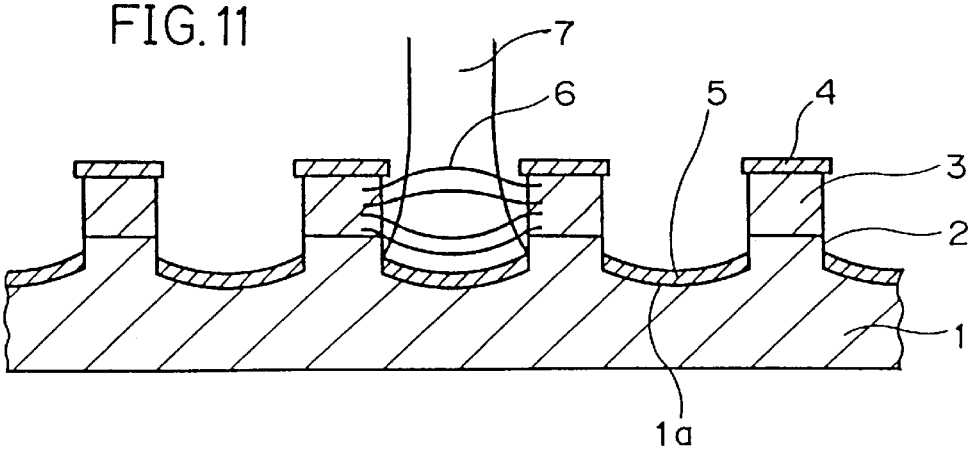
FIG. 11 is a cross-sectional view illustrating equipotential surfaces and electron beam orbits in the field emission thin film cold cathode illustrated in FIG. 9.

FIG. 11 illustrates equipotential surfaces 6 and orbits of the electron beams 7, found when electrons are emitted from the electron-emission layers 5. The beam formation electrode 2 and the electron-emission layer 5 having a spherical outer surface cooperate with each other to establish the equipotential surface 6 in the vicinity of the electron-emission layer 5 which equipotential surface 6 focus the emitted electrons towards a center of a cavity. Thus, the orbits of the electron beams 7 are focused. As a result, most emitted electrons do not impinge on the gate electrode 4 and the insulating layer 3, but pass through the gate electrode opening.

Figure 12:
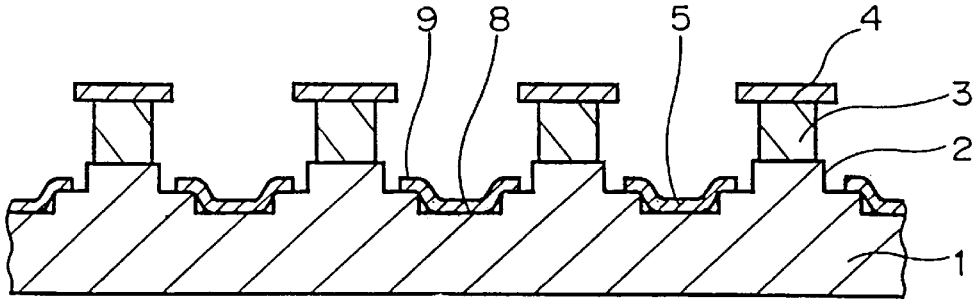
FIG. 12 is a cross-sectional view illustrating a field emission thin film cold cathode in accordance with the second embodiment of the present invention.

FIG. 12 illustrates a field emission thin film cold cathode in accordance with the second embodiment of the present invention. The field emission thin film cold cathode in accordance with the second embodiment is different from the first embodiment only in that the recesses 1*a* of the substrate 1 are not designed to have a spherical outer surface, but designed to have a curved outer surface approximated to a spherical surface by a step or steps formed at a surface of the substrate 1. The other structure is the same as that of the first embodiment. Specifically, the substrate 1 is formed with a first plane 8 disposed lowermost and a second plane 9 located slightly higher than the first plane 8. The first and second planes 8 and 9 cooperate with each other to form a step at a surface of the substrate 1. The thus formed step defines a curved surface approximated to a spherical surface.

The electron-emission layer 5 is formed on the step, and hence has an outer curved surface which is approximated to a spherical surface. The beam formation electrode 2, the first plane 8, and the second plane 9 cooperate with one another to define a focusing field in the vicinity of the electron-emission layer 5.

Figure 13:
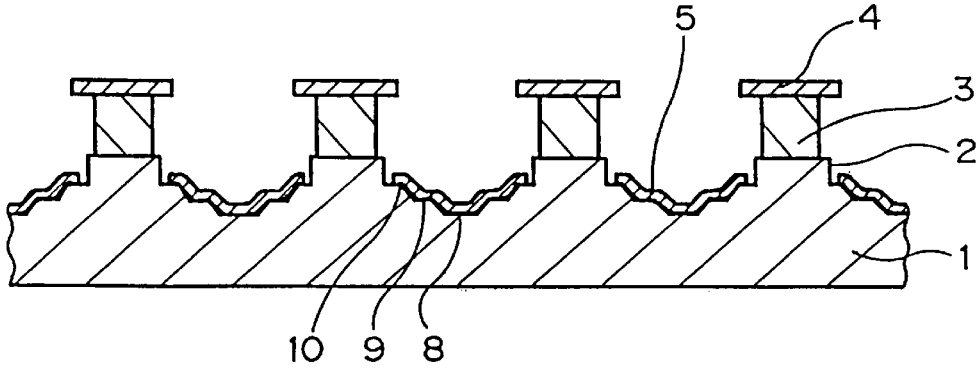
FIG. 13 is a cross-sectional view illustrating a field emission thin film cold cathode in accordance with the third embodiment of the present invention.

FIG. 13 illustrates a field emission thin film cold cathode in accordance with the third embodiment of the present invention. The field emission thin film cold cathode in accordance with the third embodiment is similar to the second embodiment illustrated in FIG. 12, but different in that the two steps are formed at a surface of the substrate 1. Specifically, the substrate 1 is formed with a first plane 8 disposed lowermost, a second plane 9 located slightly higher than the first plane 8, and a third plane 10 located slightly higher than the second plane 9. The first, second and third planes 8, 9 and 10 cooperate with one another to form two steps at a surface of the substrate 1. The thus formed two steps define a curved surface approximated to a spherical surface.

The electron-emission layer 5 is formed on the steps, and hence has an outer curved surface which is approximated to a spherical surface. The beam formation electrode 2, the first plane 8, the second plane 9, and the third plane 10 cooperate with one another to define a focusing field in the vicinity of the electron-emission layer 5.

The number of the step is not limited to one or two. Three or more steps may be formed at a surface of the substrate 1. By forming planes such as the first plane 8 by the number of N where N is a positive integer greater than 1, a step or steps can be obtained by the number of (N−1). The greater number of steps would make it possible to render a surface of the substrate 1 closer to a spherical surface.

When two or more steps are to be formed at a surface of the substrate 1, those steps may be designed to have different heights, in which case it is preferable that a step closer to a central axis of the recess 1*a* is designed to have a greater height than a height of a step more remote from the central axis of the recess 1*a*. Such a design would render a surface of the substrate 1 closer to a spherical surface. For instance, assuming that the above-mentioned design were applied to the second embodiment illustrated in FIG. 12, a first step defined by the first and second planes 8 and 9 has a greater height than a second step defined by the second and third planes 9 and 10. As an alternative, steps may be designed to have the same height.

As illustrated in FIG. 13, it is preferable that each of the steps are chamfered so that each of the steps has a rounded edge. The rounded edges of the steps would render a surface of the substrate 1 closer to a spherical surface in shape.

As illustrated in FIG. 10, the gate electrode openings and hence the electron-emission layers 5 in the first to third embodiment are designed to have a transverse rectangular cross-section. However, it should be noted that they may be designed to have a shape other than a rectangle. For instance, the gate electrode openings may be circular or hexagonal in a transverse cross-section. When the gate electrode openings are designed to have a circular transverse cross-section, an intensity of an electric field is distributed most uniformly at a surface of the electron-emission layer 5 in a direction of an electron-emission axis. However, an effective area rate, which is defined as a ratio of an electron-emission area to an entire area of an anode, is small. On the other hand, when the gate electrode openings are designed to have a hexagonal transverse cross-section, an electric field intensity distribution at a surface of the electron-emission layer 5 is more uniform than that of the electron-emission layer having a rectangular cross-section, resulting in that controllability to a current running through the gate electrode 4 is improved to thereby make it possible to control the current in the gate electrode 4 with a smaller voltage. In addition, since the hexagonal cross-section provides the same effective area rate as that of the rectangular cross-section, it would be possible to have an anode current in a greater amount than the circular cross-section.

Figure 14:
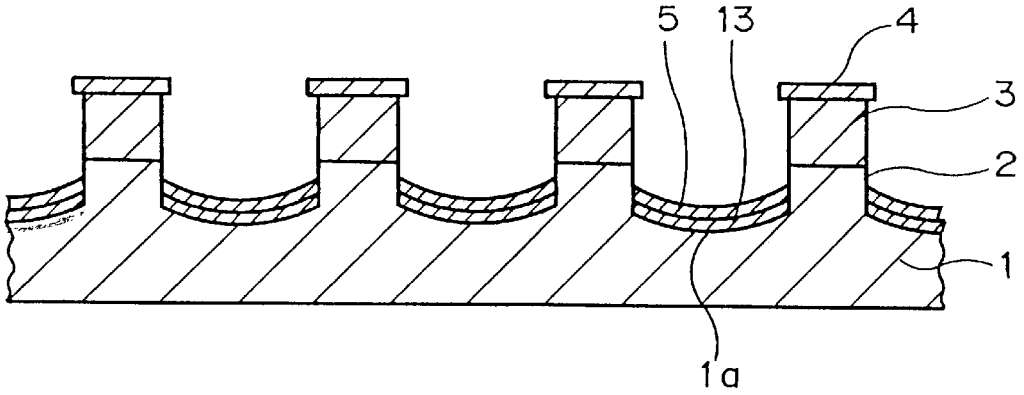
FIG. 14 is a cross-sectional view illustrating a field emission thin film cold cathode in accordance with the fourth embodiment of the present invention.

FIG. 14 illustrates a field emission thin film cold cathode in accordance with the fourth embodiment of the present invention. The field emission thin film cold cathode in accordance with the fourth embodiment is different from the first embodiment only in that the substrate 1 is made of electrically insulating material, and there is formed an cathode electrode layer 13 as the third electrode, sandwiched between the substrate 1 and the electron-emission layer 5. The substrate 1 is not always necessary to be made of electrically insulating material. The substrate 1 may be designed to merely have a surface made of electrically insulating material.

In the fourth embodiment, different voltages are applied to the beam formation electrode 2 and the cathode electrode layer 13. This ensures that a ratio of the number of electrons passing through the gate electrode opening to the number of electrons emitted from the electron-emission layer 5 is maximized. In addition, it would be possible to minimize an electron beam spot in area on a screen.

Figure 15:
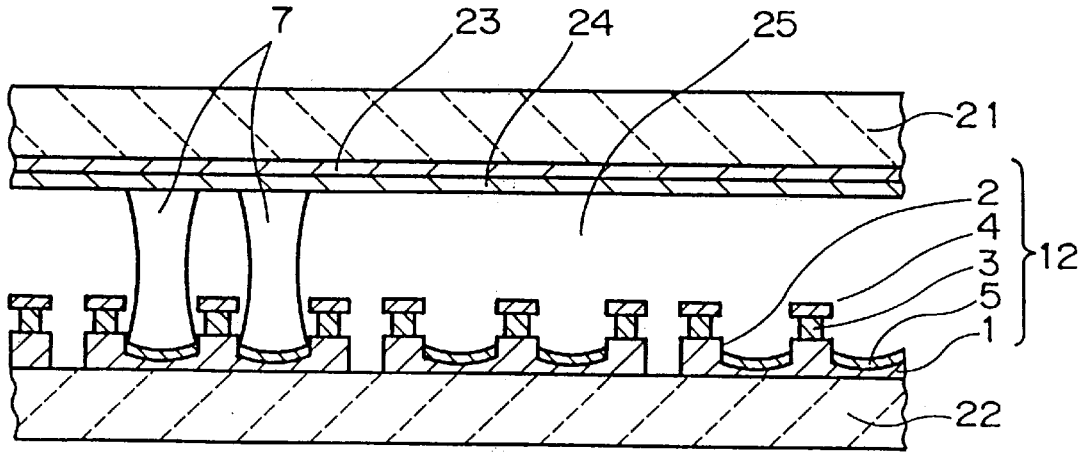
FIG. 15 is a cross-sectional view illustrating a planar display apparatus in accordance with the fifth embodiment of the present invention.

FIG. 15 illustrates a planar display apparatus in accordance with the fifth embodiment of the present invention. The illustrated planar display apparatus includes one of the field emission thin film cold cathodes illustrated in FIGS. 9 to 14.

The illustrated planar display apparatus includes a front glass 21 constituting a part of a vacuum enclosure (not illustrated), a transparent, electrically conductive film (ITO film) 23 formed on the front glass 21, a phosphor layer 24 formed on the transparent, electrically conductive layer 23, and a rear glass 22 constituting a part of the vacuum enclosure. The transparent, electrically conductive film (ITO film) 23 acts as an anode. The front and rear glasses 21 and 22 are spaced away from each other in facing relation by a distance in the range of multiple tens $\mu$m to multiple hundreds $\mu$m, and define a vacuum space 25 therebetween. The cathode 12 is formed on the rear glass 22 in facing relation to the front glass 21.

The cathode 12 includes a plurality of the stripe-shaped substrates 1 and gate electrodes 4 both of which perpendicularly intersect with each other. The stripe-shaped substrates 1 and gate electrodes 4 define scanning electrodes in column and row, respectively. A portion at which the substrate 1 perpendicularly intersects with the gate electrode 4 defines an electron source for a single pixel. In the planar display apparatus illustrated in FIG. 15, a pixel is comprised of 2×2, totally four micro cold cathodes 11. A pixel may be designed to be comprised of a single or a plurality of micro cold cathode(s) 11.

For operating the planar display apparatus illustrated in FIG. 15, a voltage in the range of a few volts to multiple tens volts is applied across the gate electrode 4 and the substrate 1 so that the gate electrode 4 is electrically positive, and a voltage in the range of 100 V to multiple hundreds V relative to the substrate 1 of the cathode 12 is applied to the anode 23. As a result, the micro cold cathode 11 in a selected pixel emits electrons, which impinge on the phosphor layer 24 to thereby cause the phosphor layer 24 to emit lights.

The anode 23 and the phosphor layer 24 may be divided into pieces in every pixel, and the thus divided pieces may be made of luminescence material having different light-emission characteristics. This arrangement turns the planar display apparatus into a color display apparatus.

In accordance with the planar display apparatus illustrated in FIG. 15, the electron beams 7 are focused by an electric field generated by the beam formation electrodes 2 of the cathode 12. Hence, fewer electrons impinge on a phosphor layer in an adjacent pixel, which ensures improvement in resolution, contrast and color purity.

In addition, a current and an accelerating voltage can be independently determined in the planar display apparatus in accordance with the fifth embodiment, which ensures that brightness, hue and so on in a screen can be optimized. Since the electron beams 7 have small divergence, and it is not necessary to take a current out of the cathode by means of an electric field formed in the vicinity of the cathode by a voltage applied across the anode and the cathode, it is no longer necessary to narrow a distance between the cathode 12 and the anode 23. As a result, the distance may be designed to be sufficiently great, which ensures reduction in vacuum exhaust resistance. In addition, since a problem about electrical isolation between a cathode and an anode can be solved to some degree by virtue of capability of making a space greater between a cathode and an anode, it would be possible to make an anode voltage higher, which ensures higher emission brightness and higher emission efficiency of light.

Though the planar display apparatus illustrated in FIG. 15 includes the field emission thin film cold cathode in accordance with the first embodiment, illustrated in FIG. 9, it should be noted that the field emission thin film cold cathode in accordance with any one of the second to fourth embodiments may be employed for the planar display apparatus.

The planar display apparatus in accordance with the fifth embodiment displays visual information by combining column and row scans. However, it should be noted that the gate electrodes 4 or the cathode electrode layers 13 may be arranged in a letter, figure or other meaningful shapes, and the phosphor layer 24 may be caused to emit lights in accordance with such a letter and so on.

Figure 16:
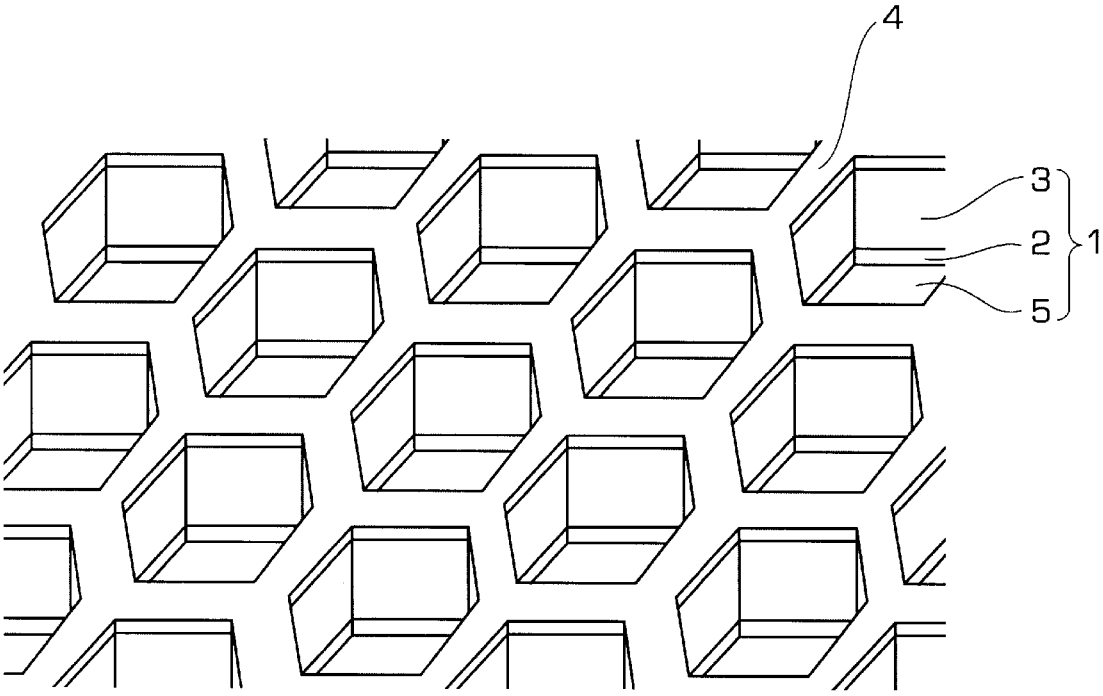
FIG. 16 is a perspective view illustrating a field emission thin film cold cathode having recesses with a hexagonal cross-section.

While the present invention has been described in connection with certain preferred embodiments, it is to be understood that the subject matter encompassed by way of the present invention is not to be limited to those specific embodiments. For instance, FIG. 16 shows an alternative embodiment of the invention, including recesses of a hexagonal cross-section. On the contrary, it is intended for the subject matter of the invention to include all alternatives, modifications and equivalents as can be included within the spirit and scope of the following claims.

The entire disclosure of Japanese Patent Application No. 8-276113 filed on Oct. 18, 1996 including specification, claims, drawings and summary is incorporated herein by reference in its entirety.

What is claimed is:

1. A field emission thin film cold cathode comprising:

(a) a substrate;

(b) an electron-emission layer formed on said substrate and having a spherical surface;

(c) a first electrode formed from said substrate and disposed about said electron-emission layer and having a greater height from said substrate than said electron-emission layer;

(d) an electrically insulating layer formed on said first electrode; and (e) a second electrode formed on said electrically insulating layer.

2. The field emission thin film cold cathode as set forth in claim 1, wherein said spherical surface has a center located at almost the same height as that of said second electrode.

3. The field emission thin film cold cathode as set forth in claim 1, wherein said spherical surface has a center located higher than said second electrode.

4. The field emission thin film cold cathode as set forth in claim 1, wherein said substrate is made of an electrical conductor or a semiconductor.

5. The field emission thin film cold cathode as set forth in claim 1, wherein said second electrode is formed with an opening having a hexagonal transverse cross-section.

6. The field emission thin film cold cathode as set forth in claim 1, wherein said electron-emission layer is made of material having a small work function.

7. The field emission thin film cold cathode as set forth in claim 6, wherein said electron-emission layer is made of at least one of monocrystalline diamond, polycrystalline diamond, and amorphous diamond.

8. The field emission thin film cold cathode as set forth in claim 1, wherein a distance between said electron-emission layer and said second electrode is equal to or greater than a half of a length of an opening formed at said second electrode.

9. The field emission thin film cold cathode as set forth in claim 1, wherein said first electrode has a height equal to or smaller than a half of a distance between said electron-emission layer and said second electrode.

10. The field emission thin film cold cathode as set forth in claim 1, wherein said substrate is formed to have a portion having a spherical surface recessed into an upper surface of said substrate, and wherein said electron-emission layer is formed on said portion of said substrate such that said electron-emission layer is recessed into said substrate.

11. A field emission thin film code cathode comprising:

(a) a substrate;

(b) an electron-emission layer formed on said substrate and having a curved surface approximated to a spherical surface;

(c) a first electrode formed from said substrate and disposed about said electron-emission layer and having a greater height from said substrate than said electron-emission layer;

(d) an electrically insulating layer formed on said first electrode; and (e) a second electrode formed on said electrically insulating layer.

12. The field emission thin film cold cathode as set forth in claim 11, wherein said curved surface has a center located at almost the same height as that of said second electrode.

13. The field emission thin film cold cathode as set forth in claim 11, wherein said curved surface has a center located higher than said second electrode.

14. The field emission thin film cold cathode as set forth in claim 11, wherein said substrate is made of an electrical conductor or a semiconductor.

15. The field emission thin film cold cathode as set forth in claim 11, wherein said second electrode is formed with an opening having a hexagonal transverse cross-section.

16. The field emission thin film cold cathode as set forth in claim 11, wherein said electron-emission layer is made of material having a small work function.

17. The field emission thin film cold cathode as set forth in claim 16, wherein said electron-emission layer is made of at least one of monocrystalline diamond, polycrystalline diamond, and amorphous diamond.

18. The field emission thin film cold cathode as set forth in claim 11, wherein a distance between said electron-emission layer and said second electrode is equal to or greater than a half of a length of an opening formed at said second electrode.

19. The field emission thin film cold cathode as set forth in claim 11, wherein said first electrode has a height equal to or smaller than a half of a distance between said electron-emission layer and said second electrode.

20. The field emission thin film cold cathode as set forth in claim 11, wherein said curved surface is approximated to a spherical surface with at least one step.

21. The field emission thin film cold cathode as set forth in claim 20, wherein said substrate is formed to have a portion having at least one step recessed from a surface of said substrate, and wherein said curved surface of said electron-emission layer is formed on said portion of said substrate to be recessed into said substrate.

22. The field emission thin film cold cathode as set forth in claim 20, wherein said step is defined by planes formed at a surface of said substrate and located at different depths measured from an uppermost surface of said substrate.

23. The field emission thin film cold cathode as set forth in claim 20, wherein said curved surface is approximated to a spherical surface with two or more steps having the same height.

24. The field emission thin film cold cathode as set forth in claim 11, wherein said curved surface is approximated to a spherical surface with two or more steps having different heights.

25. The field emission thin film cold cathode as set forth in claim 24, wherein a step closer to a central axis of said curved surface has a greater height relative to an uppermost surface of said substrate than a height of a step more remote from said central axis.

26. The field emission thin film cold cathode as set forth in claim 20, wherein said step is chamfered.

27. The field emission thin film cold cathode as set forth in claim 26, wherein said step is chamfered so that said step has a rounded edge.

28. A field emission thin film cold cathode comprising:

(a) a substrate wherein a part of a surface of said substrate is made of electrically insulating material;

(b) a first electrode formed on said substrate;

(c) an electron-emission layer formed on said first electrode and having a spherical surface;

(d) a second electrode formed from said substrate and disposed about said electron-emission layer and having a greater height from said substrate than said electron-emission layer;

(e) an electrically insulating layer formed on said second electrode; and (f) a third electrode formed on said electrically insulating layer.

29. The field emission thin film cold cathode as set forth in claim 28, wherein said spherical surface has a center located at almost the same height as that of said second electrode.

30. The field emission thin film cold cathode as set forth in claim 28, wherein said spherical surface has a center located higher than said second electrode.

31. The field emission thin film cold cathode as set forth in claim 28, wherein said substrate is made of an electrical conductor or a semiconductor.

32. The field emission thin film cold cathode as set forth in claim 28, wherein said second electrode is formed with an opening having a hexagonal transverse cross-section.

33. The field emission thin film cold cathode as set forth in claim 28, wherein said electron-emission layer is made of material having a small work function.

34. The field emission thin film cold cathode as set forth in claim 33, wherein said electron-emission layer is made of at least one of monocrystalline diamond, polycrystalline diamond, and amorphous diamond.

35. The field emission thin film cold cathode as set forth in claim 28, wherein a distance between said electron-emission layer and said third electrode is equal to or greater than a half of a length of an opening formed at said third electrode.

36. The field emission thin film cold cathode as set forth in claim 28, wherein said second electrode has a height equal to or smaller than a half of a distance between said electron-emission layer and said third electrode.

37. The field emission thin film cold cathode as set forth in claim 28, wherein said substrate is formed to have a portion having a spherical surface recessed into a surface of said substrate, and wherein said first electrode and said electron-emission layer are formed on said portion of said substrate such that said first electrode and said electrode-emission layer are recessed into said substrate.

38. The field emission thin film cold cathode as set forth in claim 28, wherein different voltages are independently applied to said first and second electrodes.

39. A field emission thin film cold cathode comprising:

(a) a substrate wherein a part of a surface of said substrate is made of electrically insulating material:

(b) a first electrode formed on said substrate;

(c) an electron-emission layer formed on said first electrode and having a curved surface approximated to a spherical surface;

(d) a second electrode formed from said substrate and disposed about said electron-emission layer and having greater height from said substrate than said electron-emission layer;

(e) an electrically insulating layer formed on said second electrode; and (f) a third electrode formed on said electrically insulating layer.

40. The field emission thin film cold cathode as set forth in claim 39, wherein said curved surface has a center located at almost the same height as that of said third electrode.

41. The field emission thin film cold cathode as set forth in claim 39, wherein said curved surface has a center located higher than said third electrode.

42. The field emission thin film cold cathode as set forth in claim 39, wherein said substrate is made of an electrical conductor or a semiconductor.

43. The field emission thin film cold cathode as set forth in claim 39, wherein said second electrode is formed with an opening having a hexagonal transverse cross-section.

44. The field emission thin film cold cathode as set forth in claim 39, wherein said electron-emission layer is made of material having a small work function.

45. The field emission thin film cold cathode as set forth in claim 44, wherein said electron-emission layer is made of at least one of monocrystalline diamond, polycrystalline diamond, and amorphous diamond.

46. The field emission thin film cold cathode as set forth in claim 39, wherein a distance between said electron-emission layer and said third electrode is equal to or greater than a half of a length of an opening formed at said third electrode.

47. The field emission thin film cold cathode as set forth in claim 39, wherein said second electrode has a height equal to or smaller than a half of a distance between said electron-emission layer and said third electrode.

48. The field emission thin film cold cathode as set forth in claim 39, wherein said curved surface is approximated to a spherical surface with at least one step.

49. The field emission thin film cold cathode as set forth in claim 39, wherein said substrate is formed to have a portion having at least one step recessed from an upper surface of said substrate, and wherein said first electrode and said curved surface of said electron-emission layer are formed on said portion of said substrate to be recessed in said substrate.

50. The field emission thin film cold cathode as set forth in claim 39, wherein different voltages are independently applied to said first and second electrodes.

51. The field emission thin film cold cathode as set forth in claim 48, wherein said step is defined by planes formed at a surface of said substrate and located at different depths measured from an uppermost surface of said substrate.

52. The field emission thin film cold cathode as set forth in claim 48, wherein said curved surface is approximated to a spherical surface with two or more steps having the same height.

53. The field emission thin film cold cathode as set forth in claim 39, wherein said curved surface is approximated to a spherical surface with two or more steps having different heights.

54. The field emission thin film cold cathode as set forth in claim 53, wherein a step closer to a central axis of said curved surface has a greater height relative to an uppermost surface of said substrate than a height of a step more remote from said central axis.

55. The field emission thin film cold cathode as set forth in claim 48, wherein said step is chamfered.

56. The field emission thin film cold cathode as set forth in claim 55, wherein said step is chamfered so that said step has a rounded edge.

57. A display including a field emission thin film cold cathode, said field emission thin film cold cathode comprising:

(a) a substrate;

(b) an electron-emission layer formed on said substrate and having a spherical surface;

(c) a first electrode formed from said substrate and disposed about said electron-emission layer and having a greater height from said substrate than said electron-emission layer;

(d) an electrically insulating layer formed on said first electrode; and (e) a second electrode formed on said electrically insulating layer.

58. The display as set forth in claim 57, wherein said spherical surface has a center located at almost the same height as that of said second electrode.

59. The display as set forth in claim 57, wherein said spherical surface has a center located higher than said second electrode.

60. The display as set forth in claim 57, wherein said substrate is made of an electrical conductor or a semiconductor.

61. The display as set forth in claim 57, wherein said second electrode is formed with an opening having a hexagonal transverse cross-section.

62. The display as set forth in claim 57, wherein said electron-emission layer is made of material having a small work function.

63. The display as set forth in claim 62, wherein said electron-emission layer is made of at least one of monocrystalline diamond, polycrystalline diamond, and amorphous diamond.

64. The display as set forth in claim 57, wherein a distance between said electron-emission layer and said second electrode is equal to or greater than a half of a length of an opening formed at said second electrode.

65. The display as set forth in claim 57, wherein said first electrode has a height equal to or smaller than a half of a distance between said electron-emission layer and said second electrode.

66. The display as set forth in claim 57, wherein said substrate is formed to have a portion having a spherical surface recessed into an upper surface of said substrate, and wherein said electron-emission layer is formed on said portion of said substrate such that said electron emission layer is recess into said substrate.

67. The display as set forth in claim 57, wherein said electron-emission has a curved outer surface approximated to a spherical surface.

68. The display as set forth in claim 67, wherein said curved outer surface is approximated to a spherical surface with at least one step.

69. The display as set forth in claim 68, wherein said substrate is formed to have a portion having at least one step, and wherein said curved surface is formed on said portion of said substrate.

70. The display as set forth in claim 57, wherein said display includes a plurality of said field emission thin film cold cathodes arranged in an array.

71. The display as set forth in claim 68, wherein said step is defined by planes formed at a surface of said substrate and located at different depths measured from an uppermost surface of said substrate.

72. The display as set forth in claim 68, wherein said curved surface is approximated to a spherical surface with two or more steps having the same height.

73. The display as set forth in claim 68, wherein said curved surface is approximated to a spherical surface with two or more steps having different heights.

74. The display as set forth in claim 73, wherein a step closer to a central axis of said curved surface has a greater height relative to an uppermost surface of said substrate than a height of a step more remote from said central axis.

75. The display as set forth in claim 68, wherein said step is chamfered.

76. The display as set forth in claim 75, wherein said step is chamfered so that said step has a rounded edge.

77. A display including a field emission thin film cold cathode, said field emission thin film cathode comprising:

(a) a substrate wherein a part of a surface of said substrate is made of electrically insulating material;

(b) a first electrode formed on said substrate;

(c) an electron-emission layer formed on said first electrode and having a spherical surface;

(d) a second electrode formed from said substrate and disposed about said electron-emission layer and having a greater height from said substrate than said electron-emission layer;

(e) an electrically insulating layer formed on said second electrode; and (f) a third electrode formed on said electrically insulating layer.

78. The display as set forth in claim 77, wherein said spherical surface has a center located at almost the same height as that of said third electrode.

79. The display as set forth in claim 77, wherein said spherical surface has a center located higher than said third electrode.

80. The display as set forth in claim 77, wherein said substrate is made of an electrical conductor or a semiconductor.

81. The display as set forth in claim 77, wherein said second electrode is formed with an opening having a hexagonal transverse cross-section.

82. The display as set forth in claim 77, wherein said electron-emission layer is made of material having a small work function.

83. The display as set forth in claim 82, wherein said electron-emission layer is made of at least one of monocrystalline diamond, polycrystalline diamond, and amorphous diamond.

84. The display as set forth in claim 77, wherein a distance between said electron-emission layer and said third electrode is equal to or greater than a half of a length of an opening formed at said second electrode.

85. The display as set forth in claim 77, wherein said second electrode has a height equal to or smaller than a half of a distance between said electron-emission layer and said third electrode.

86. The display as set forth in claim 77, wherein said substrate is formed to have a portion having a spherical surface recessed into an upper surface of said substrate, and wherein said first electrode and said electron-emission layer are formed on said portion of said substrate such that said first electrode and said electron-emission layer are recessed into said substrate.

87. The display as set forth in claim 77, wherein different voltages are independently applied to said first and second electrodes.

88. The display as set forth in claim 77, wherein said electron-emission layer has a curved surface approximated to a spherical surface.

89. The display as set forth in claim 88, wherein said curved surface is approximated to a spherical surface with at least one step.

90. The display as set forth in claim 89, wherein said substrate is formed to have a portion having at least one step, and wherein said curved surface is formed on said portion of said substrate.

91. The display as set forth in claim 77, wherein said display includes a plurality of said field emission thin film cold cathodes arranged in an array.

92. The display as set forth in claim 89, wherein said step is defined by planes formed at a surface of said substrate and located at different depths measured from an uppermost surface of said substrate.

93. The display as set forth in claim 89, wherein said curved surface is approximated to a spherical surface with two or more steps having the same height.

94. The display as set forth in claim 88, wherein said curved surface is approximated to a spherical surface with two or more steps having different heights.

95. The display as set forth in claim 94, wherein a step closer to a central axis of said curved outer surface has a greater height relative to an uppermost surface of the substrate than a height of a step more remote from said central axis.

96. The display as set forth in claim 89, wherein said step is chamfered.

97. The display as set forth in claim 96, wherein said step is chamfered so that said step has a rounded edge.

98. A display comprising:

(a) a front glass constituting a part of a vacuum enclosure;

(b) a light-permeable, electrically conductive layer formed on said front glass;

(c) a phosphor layer formed on said light-permeable, electrically conductive layer;

(d) a rear glass constituting a part of said vacuum enclosure and disposed in facing relation with said front glass; and (e) a field emission thin film cold cathode formed on said rear glass, said field emission thin film cold cathode comprising:

(1) a substrate;

(2) an electron-emission layer formed on said substrate and having a spherical surface;

(3) a first electrode formed from said substrate and disposed about said electron-emission layer and having a greater height from said substrate than said electron-emission layer;

(4) an electrically insulating layer formed on said first electrode; and (5) a second electrode formed on said electrically insulating layer.

99. The display as set forth in claim 98, wherein said spherical surface has a center located at almost the same height as that of said second electrode.

100. The display as set forth in claim 98, wherein said spherical surface has a center located higher than said second electrode.

101. The display as set forth in claim 98, wherein said substrate is made of an electrical conductor or a semiconductor.

102. The display as set forth in claim 98, wherein said second electrode is formed with an opening having a hexagonal transverse cross-section.

103. The display as set forth in claim 98, wherein said electron-emission layer is made of material having a small work function.

104. The display as set forth in claim 103, wherein said electron-emission layer is made of at least one of monocrystalline diamond, polycrystalline diamond, and amorphous diamond.

105. The display as set forth in claim 98, wherein a distance between said electron-emission layer and said second electrode is equal to or greater than a half of a length of an opening formed at said second electrode.

106. The display as set forth in claim 98, wherein said first electrode has a height equal to or smaller than a half of a distance between said electron-emission layer and said second electrode.

107. The display as set forth in claim 98, wherein said substrate is formed to have a portion having a spherical surface recessed into an upper surface of said substrate, and wherein said electron-emission layer is formed on said portion of said substrate such that said electron-emission layer is recessed into said substrate.

108. The display as set forth in claim 98, wherein said electron-emission layer has a curved surface approximated to a spherical surface.

109. The display as set forth in claim 108, wherein said curved surface is approximated to a spherical surface with at least one step.

110. The display as set forth in claim 109, wherein said substrate is formed to have a portion having at least one step, and wherein said curved surface is formed on said portion of said substrate.

111. The display as set forth in claim 98, wherein said display includes a plurality of said field emission thin film cold cathodes arranged in an array.

112. The display as set forth in claim 109, wherein said step is defined by planes formed at a surface of said substrate and located at different depths measured from an uppermost surface of said substrate.

113. The display as set forth in claim 109, wherein said curved surface is approximated to a spherical surface with two or more steps having the same height.

114. The display as set forth in claim 108, wherein said curved surface is approximated to a spherical surface with two or more steps having different heights.

115. The display as set forth in claim 114, wherein a step closer to a central axis of said curved surface has a greater height relative to an uppermost surface of said substrate than a height of a step more remote from said central axis.

116. The display as set forth in claim 109, wherein said step is chamfered.

117. The display as set forth in claim 116, wherein said step is chamfered so that said step has a rounded edge.

118. A display comprising:

(a) a front glass constituting a part of a vacuum enclosure;

(b) a light-permeable, electrically conductive layer formed on said front glass;

(c) a phosphor layer formed on said light-permeable, electrically conductive layer;

(d) a rear glass constituting a part of said vacuum enclosure and disposed in facing relation with said front glass; and (e) a field emission thin film cold cathode formed on said rear glass, said field emission thin film cathode comprising;

(1) a substrate wherein a part of a surface of said substrate is made of electrically insulating material;

(2) a first electrode formed on said substrate;

(3) an electron-emission layer formed on said first electrode and having a spherical surface;

(4) a second electrode formed from said substrate and disposed about said electron-emission layer and having a greater height from said substrate than said electron-emission layer;

(5) an electrically insulating layer formed on said second electrode; and (6) a third electrode formed on said electrically insulating layer.

119. The display as set forth in claim 118, wherein said spherical surface has a center located at almost the same height as that of said third electrode.

120. The display as set forth in claim 118, wherein said spherical surface has a center located higher than said third electrode.

121. The display as set forth in claim 118, wherein said substrate is made of an electrical conductor or a semiconductor.

122. The display as set forth in claim 118, wherein said second electrode is formed with an opening having a hexagonal transverse cross-section.

123. The display as set forth in claim 118, wherein said electron-emission layer is made of material having a small work function.

124. The display as set forth in claim 123, wherein said electron-emission layer is made of at least one of monocrystalline diamond, polycrystalline diamond, and amorphous diamond.

125. The display as set forth in claim 118, wherein a distance between said electron-emission layer and said third electrode is equal to or greater than a half of a length of an opening formed at said third electrode.

126. The display as set forth in claim 118, wherein said second electrode has a height equal to or smaller than a half of a distance between said electron-emission layer and said third electrode.

127. The display as set forth in claim 118, wherein said substrate is formed to have a portion having a spherical surface recessed into an upper surface of said substrate, and wherein said first electrode and said electron-emission layer are formed on said portion of said substrate so that said first electrode and said electron-emission layer are recessed into said substrate.

128. The display as set forth in claim 118, wherein different voltages are independently applied to said first and second electrodes.

129. The display as set forth in claim 118, wherein said electron-emission has a curved surface approximated to a spherical surface.

130. The display as set forth in claim 129, wherein said curved surface is approximated to a spherical surface with at least one step.

131. The display as set forth in claim 130, wherein said substrate is formed to have a portion having at least one step, and wherein said curved surface is formed on said portion of said substrate.

132. The display as set forth in claim 118, wherein said display includes a plurality of said field emission thin film cold cathodes arranged in an array.

133. The display as set forth in claim 130, wherein said step is defined by planes formed at a surface of said substrate and located at different depths measured from an uppermost surface of said substrate.

134. The display as set forth in claim 130, wherein said curved outer surface is approximated to a spherical surface with two or more steps having the same height.

135. The display as set forth in claim 129, wherein said curved outer surface is approximated to a spherical surface with two or more steps having different heights.

136. The display as set forth in claim 135, wherein a step closer to a central axis of said curved outer surface has a greater height relative to an uppermost surface of the substrate than a height of a step more remote from said central axis.

137. The display as set forth in claim 130, wherein said step is chamfered.

138. The display as set forth in claim 137, wherein said step is chamfered so that said step has a rounded edge.

* * * * *